US006099200A

United States Patent [19]

Pepe et al.

[11] Patent Number: 6,099,200

[45] Date of Patent: Aug. 8, 2000

[54] ANTI-TERROR BOLLARD

[76] Inventors: John J. Pepe, Koenigsberger Str. 26, 12207 Berlin; Klaus Goeken, Ringbahn Str. 8a, 10711 Berlin, both of Germany

[21] Appl. No.: 09/165,427

[22] Filed: Oct. 2, 1998

[51] Int. Cl.[7] ..... E01F 13/00

[52] U.S. Cl. ..... 404/6; 404/9; 256/13.1

[58] Field of Search ..... 404/6, 7, 8, 9; 256/13.1, 13.3

[56] References Cited

U.S. PATENT DOCUMENTS

| | | | |
|---|---|---|---|
| 4,003,161 | 1/1977 | Collins | 49/35 |
| 4,576,508 | 3/1986 | Dickinson | 49/131 |
| 4,577,991 | 3/1986 | Rolow | 404/6 |
| 4,715,742 | 12/1987 | Dickenson | 404/6 |
| 4,824,282 | 4/1989 | Waldecker | 404/6 |
| 4,858,382 | 8/1989 | Blair . | |
| 4,861,185 | 8/1989 | Eikelenboon | 404/6 |
| 4,919,563 | 4/1990 | Stice | 404/6 |
| 5,070,646 | 12/1991 | Colombo . | |
| 5,192,157 | 3/1993 | Laturner | 404/6 |
| 5,365,694 | 11/1994 | Macaluso . | |
| 5,403,113 | 4/1995 | Gertz et al. | 404/6 |
| 5,462,384 | 10/1995 | Arlandis | 404/6 |
| 5,476,338 | 12/1995 | Alberts | 404/6 |
| 5,560,733 | 10/1996 | Dickinson | 404/6 |
| 5,605,414 | 2/1997 | Fuller et al. | 404/6 |

*Primary Examiner*—Eileen Dunn Lillis
*Assistant Examiner*—Raymond Addie
*Attorney, Agent, or Firm*—Ralph J. Mancini Esq.

[57] ABSTRACT

An energy absorbing, retractable security barrier used to stop the movement of vehicles. The device is employed to control access to entranceways, driveways, roads and to secure a security perimeter around buildings and objects requiring such protection. The device consists of a reinforced telescoping bollard inserted into a foundation casing which is imbedded below ground. The device is manually operated and is extended by a self-contained gas-charged spring lift mechanism. The device contains a locking mechanism for securing the telescoping bollard in the extended and retracted positions. When in the retracted position the bollard is flush with the surface and can be traversed by a vehicle. The device is of simple design, easily installed and easily maintained.

16 Claims, 9 Drawing Sheets

ANTI-TERROR BOLLARD

BACKGROUND OF THE INVENTION

1. Field of the Invention

The present invention relates to an improved anti-terrorist and security barrier for use in stopping the movement of vehicles. The device is employed to control access to entranceways, driveways, and roads and to secure a security perimeter around buildings and objects requiring such protection. The device consists of a telescoping bollard inserted into a foundation casing imbedded below ground. The device is manually retracted, is extended by a lift element comprising multi-spring lift mechanism and contains a locking mechanism for securing the telescoping bollard in the extended and retracted positions. When in the retracted position the bollard is flush with the surface and can be traversed by a vehicle.

2. Description of the Related Art

Various security devices employed to control access to entranceways have been proposed. Often found are articulating devices, which consists of an arm or barrier that is pivotally connected to a hydraulic base. The arm or barrier when employed is then raised from a horizontal blocking position to a vertical open position. U.S. Pat. No. 4,858,328 issued to Ellgass is one such device. A disadvantage of such devices is that they are not of reinforced construction and as such cannot arrest the movement of a vehicle. Additionally, such devices are exposed above ground making them subject to vandalism and excessive damage from vehicles hitting them and therefore require frequent repair or replacement.

U.S. Pat. No. 4,576,508 issued to Dickenson is described as an anti-terror barricade capable of stopping the movement of vehicles. This art employs a below the surface bollard raised by a hydraulic lift mechanism. The hydraulic lift mechanism is activated through an electrical control system. Underground environmental exposure to a subterranean electronic device and subterranean hydraulic system is undesirable. Maintenance for hydraulic systems is also very extensive and expensive. Operation based upon two dependent power sources (electrical power and hydraulic power) degrades reliability.

U.S. Pat. No. 4,715,742 issued to Dickinson is also an anti-terror barricade intended to stop the movement of vehicles. This below the surface bollard is raised by the stored energy of a metal coil compression spring. The coil spring is released and locked through an electronically or manually engaged bolt. The bolt and the control box, which houses the bolt, are recessed just below grade level. Access to the control is through a locked cover. Both the bolt and the cover to the control box are located too close to the surface and could result in sabotage or vandalism to the device. This device is flirther disadvantaged in that it relies on a single spring as a lift mechanism and additionally since it can be manually raised it is inherently of lighter construction.

U.S. Pat. No. 4,577,991 issued to Rolow is a vehicle barricade apparatus for arresting the movement of vehicles. These devices as well as the two Dickinson patents above are disadvantaged in that they are intended to be employed instantaneously in the event of a terrorist attack. They are dependent upon the decision of a human to activate the device and are all dependent upon a single lift means without a redundancy capability.

Other prior art include systems that employ bollards encased below the surface. U.S. Pat. No. 4,919,563 issued to Stice and U.S. Pat. No. 5,476,338 issued to Alberts are exemplary of this art. The Stice and Alberts devices are relatively complicated employing a worm gear/screw lift mechanisms and are dependent upon underground motors and external power sources (Electrical Current or Battery) for their operation. Underground environmental exposure to subterranean electronic devices is undesirable. Both devices contain a large number of parts and components. Maintenance for these types of devices is rather extensive. Both devices are primarily designed to control ingress/egress to entranceways; however, they are of light construction and not intended as anti-terror devices.

Further art also include telescoping posts that are raised exclusively through the stored energy of single pneumatic or hydraulic springs. These devices are affected often by temperature variations. They are disadvantaged, in that in extremely cold temperatures the stored energy of the single spring can be severely degraded to the point where effective operation of the device through the exclusive power of the spring may not be feasible or to the point where an extremely powerful spring is required to operate in cold temperatures. Such a powerful spring would require extreme manual pressure to retract the device making the retraction very difficult.

U.S. patent application Ser. No. 08/967800 (Citylift/Goeken and Pepe) is disadvantaged in that it is not intended to stop the movement of vehicles, but, only to reserve a parking space or control access to entrance ways under non-hostile conditions. As such, this device is not reinforced, and is dependent upon a single gas spring as a lift mechanism.

An object of the present invention is to provide a multi-gas spring lift assisted telescoping anti-terror security bollard that is functional within a wide temperature range, a telescoping bollard that ensures continued operation via a redundant multi-gas spring lift mechanism, a telescoping bollard which displays great strength and stability, and one that is easy to install and operate. Accordingly, there is also a need for such a device that has few parts and is easy to repair.

Another object of the bollard is to provide a device that is extremely sturdy, stable and one which would take a long period of time to defeat thus resulting in the prolonged exposure of someone attemp ting to tamper with the device.

Accordingly, it is an object of the present art to provide a gas spring lift assisted telescoping security bollard that is functional within a wide temperature range.

A further object is to provide a telescoping bollard that displays great strength and stability and provides for continued operation through the employment of a redundant multiple gas spring lift mechanism.

An object of the present invention is to provide a telescoping security bollard that is easy to install and is easy to maintain and reliable in its employment.

A further object of the present invention is to provide a security bollard that is of simple design, has few components, and one that is economically priced.

Still a further object of the present invention is to provide a telescoping bollard that guarantees proper drainage and one that will not have its operation be adversely affected by dirt and debris or extreme climatic conditions.

Finally, it is a further object of the present invention is to present a telescoping security bollard that is locked in both the extended and retracted positions. These and other objects are satisfied by the device of the present invention.

SUMMARY OF THE INVENTION

The present invention relates to an improved anti-terrorist and security barrier for use in arresting the movement of vehicles. The device is employed to control access to entranceways, driveways, and roads and to secure a security perimeter around buildings and objects requiring such protection. The device consists of a foundation casing member, the casing member adapted to be installed below grade; a bollard member telescopically positioned in relation to the casing member, the bollard member being retractable and extendable with respect to the casing member; and a multi-spring member affixed between the casing member and the bollard member, the spring mechanism adapted to provide lift between the casing member and the bollard member; wherein the stored energy of the multi-spring member is at equilibrium with the weight of the bollard member, such that retraction and extension of the bollard member with respect to the casing member is independent of temperature variations.

The device can absorb severe impacts and is oriented toward the direction of vehicular impact. The device is manually retracted, is extended by a multi-gas spring element and contains a locking mechanism for securing the telescoping bollard in the extended and retracted positions. When in the retracted position the bollard is flush with the surface and can be traversed by a vehicle.

DETAILED DESCRIPTION OF THE DRAWINGS

Figure 1A:
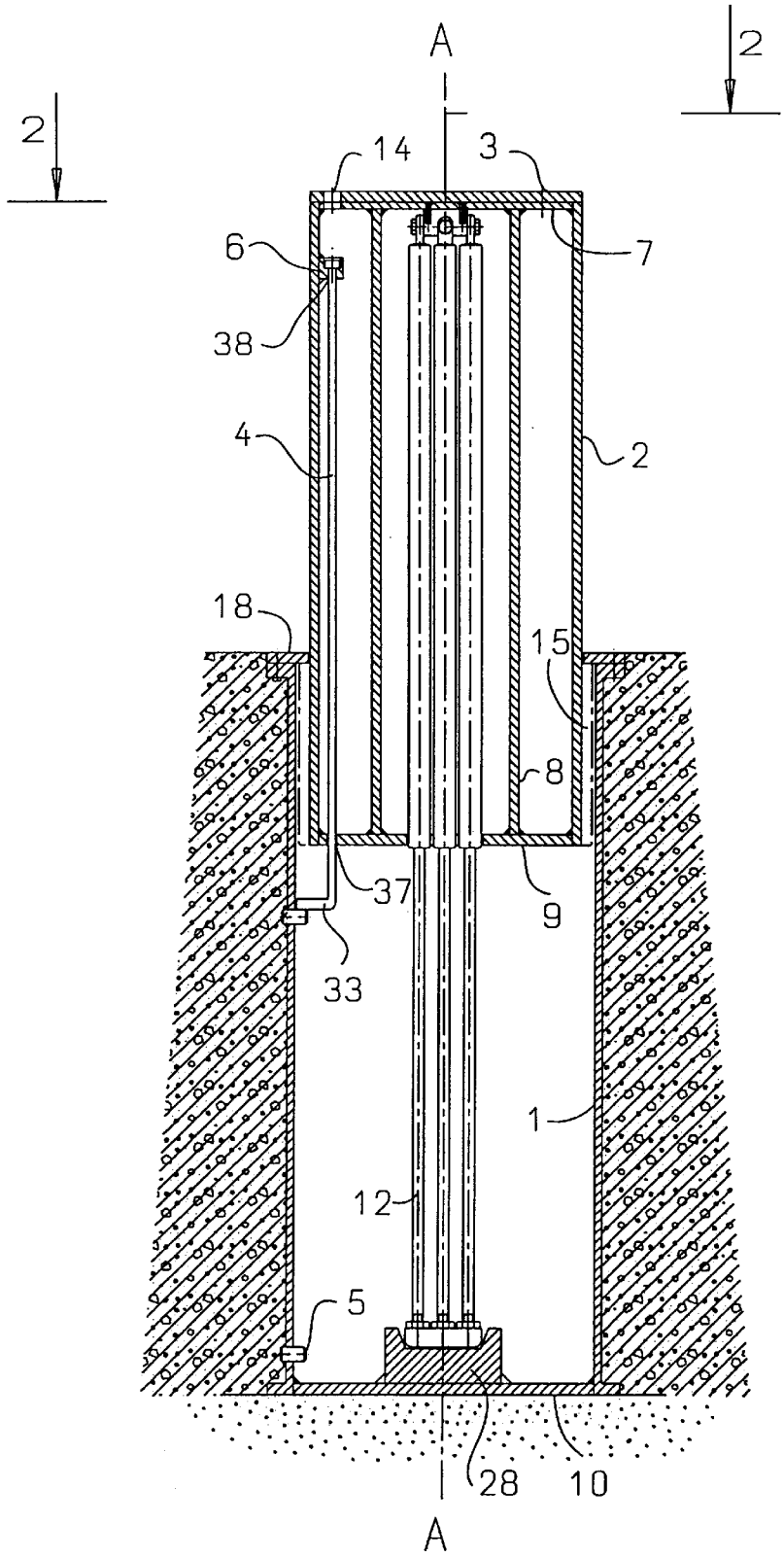

FIG. 1*a* is an enlarged side view of the device illustrating an extended position.

Figure 1B:
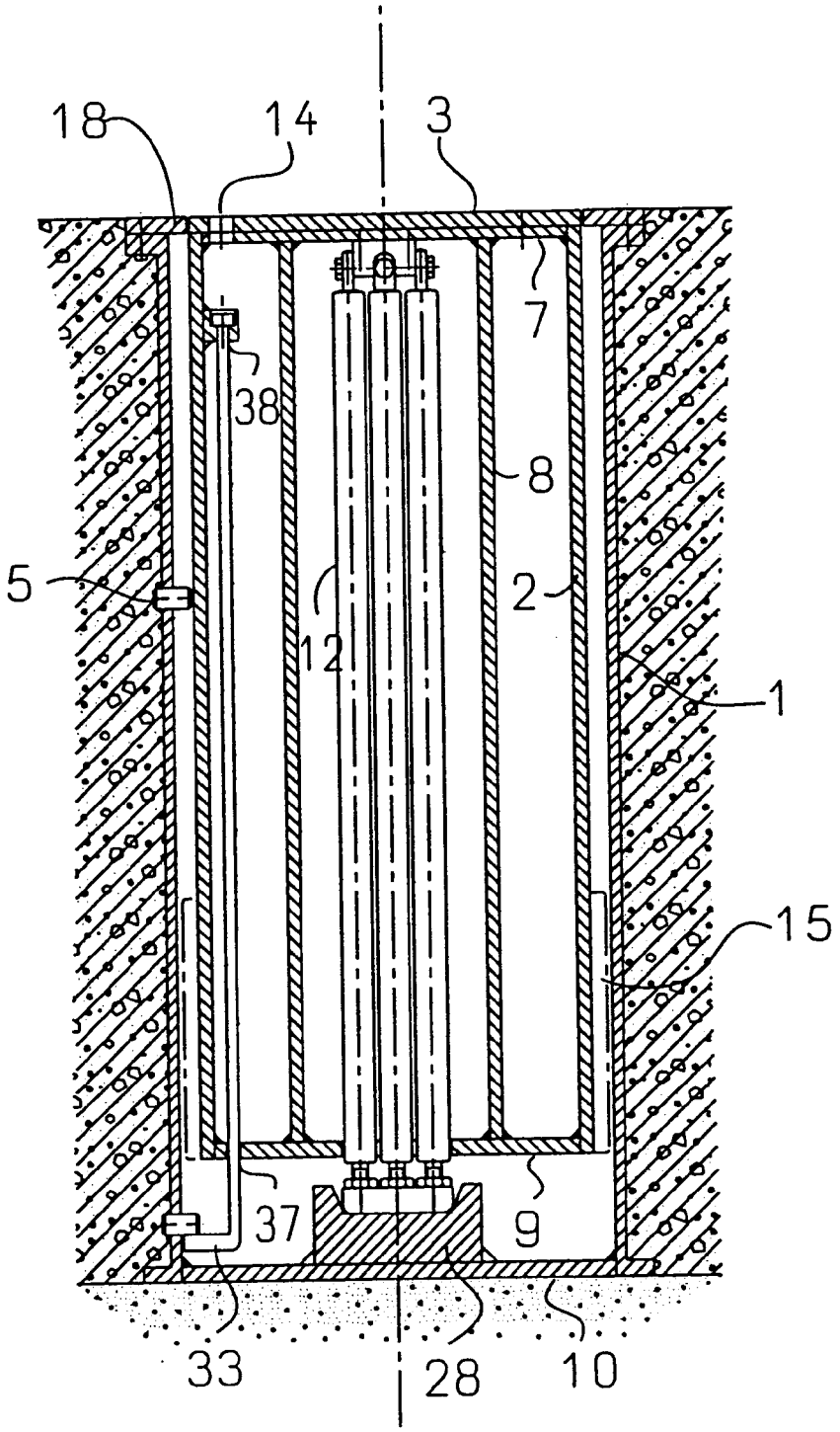

FIG. 1*b* is an enlarged side view of the device illustrating a retracted position.

Figure 1C:
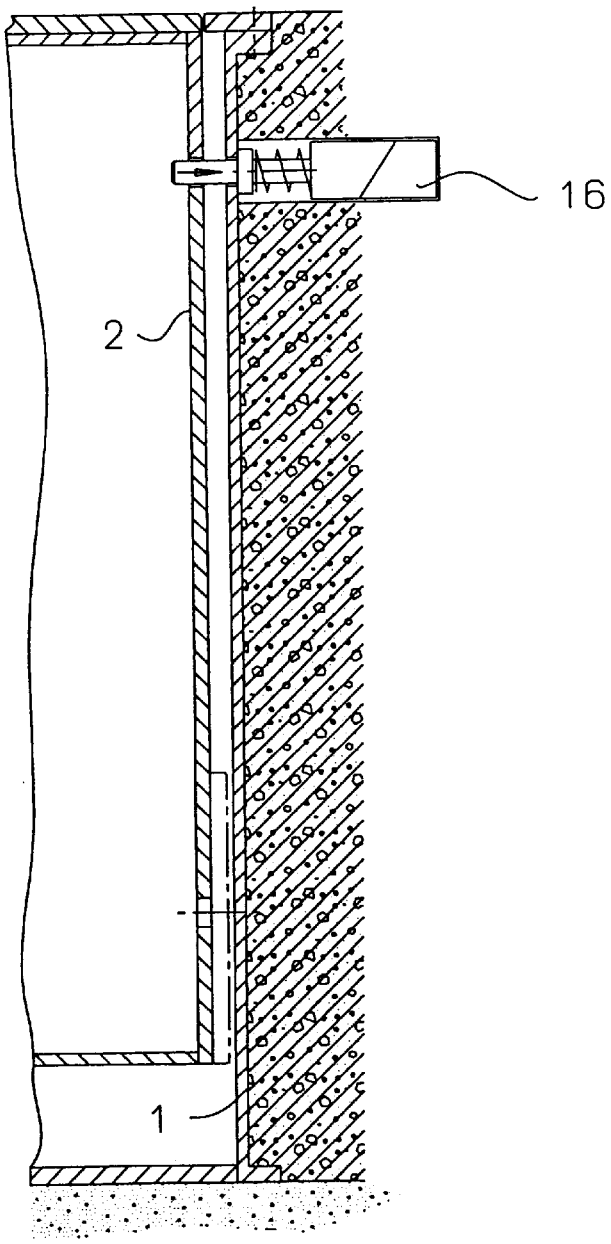

FIG. 1*c* is an enlarged side view of the device illustrating an optional electronic activation device.

Figure 2:
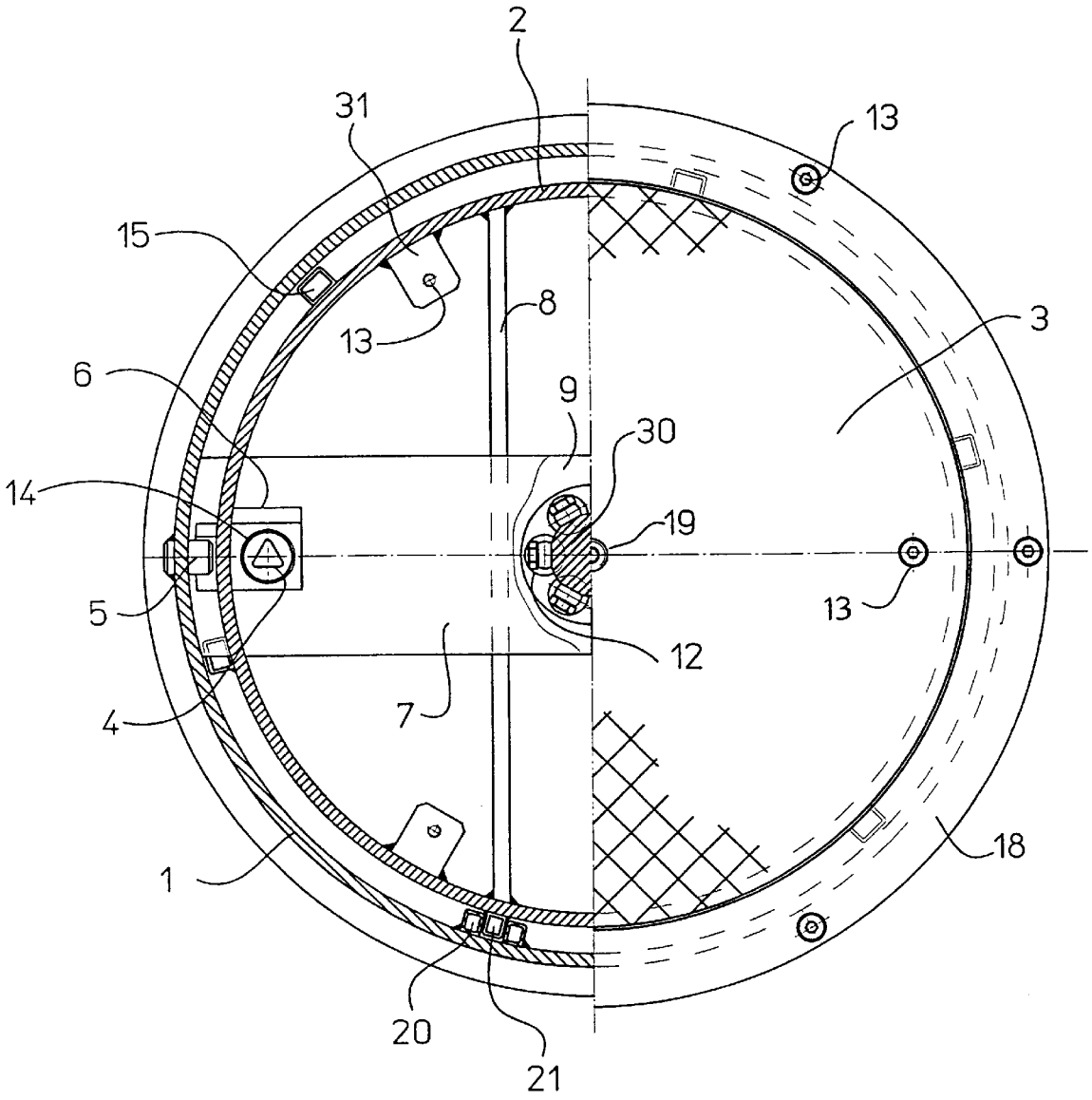

FIG. 2 is a top plan view of the device.

Figure 3A:
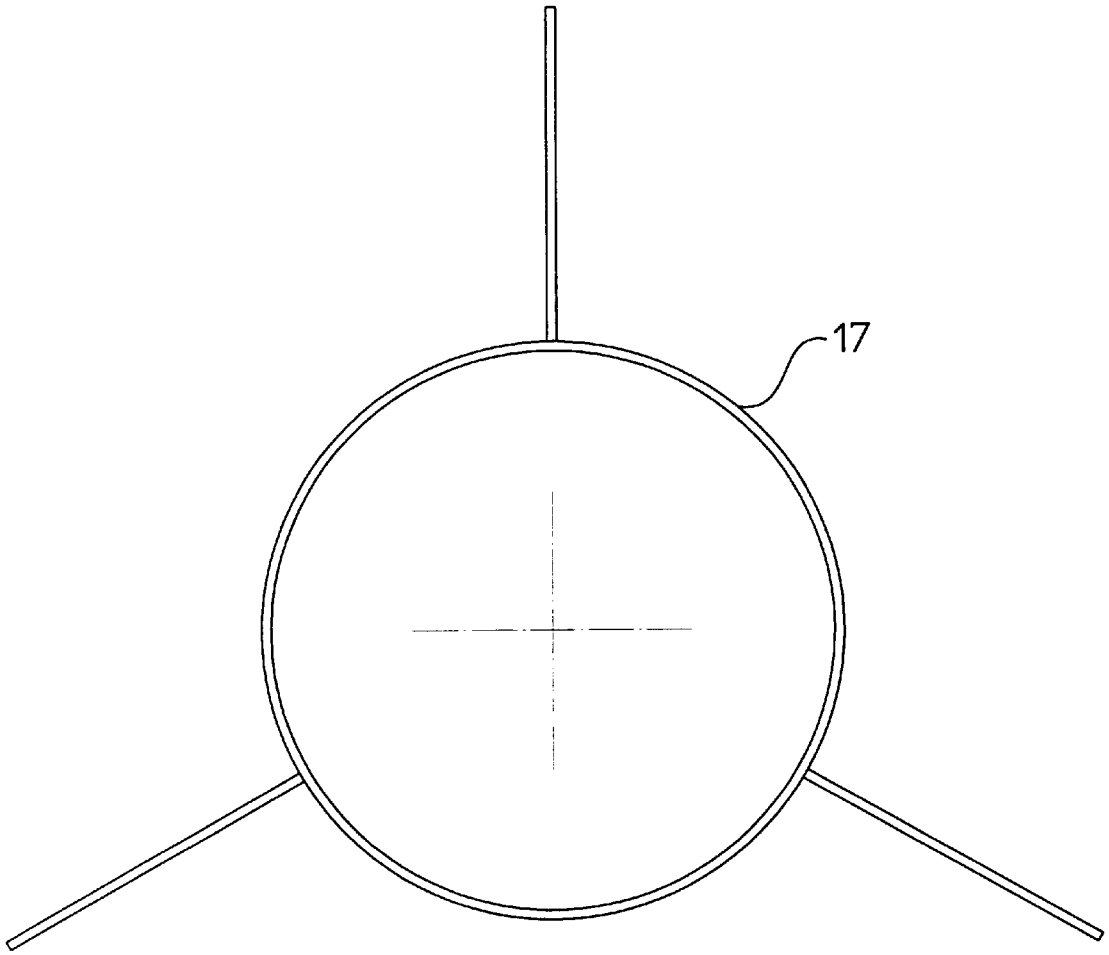

FIG. 3*a* is a top view of the subterranean anchor.

Figure 3B:
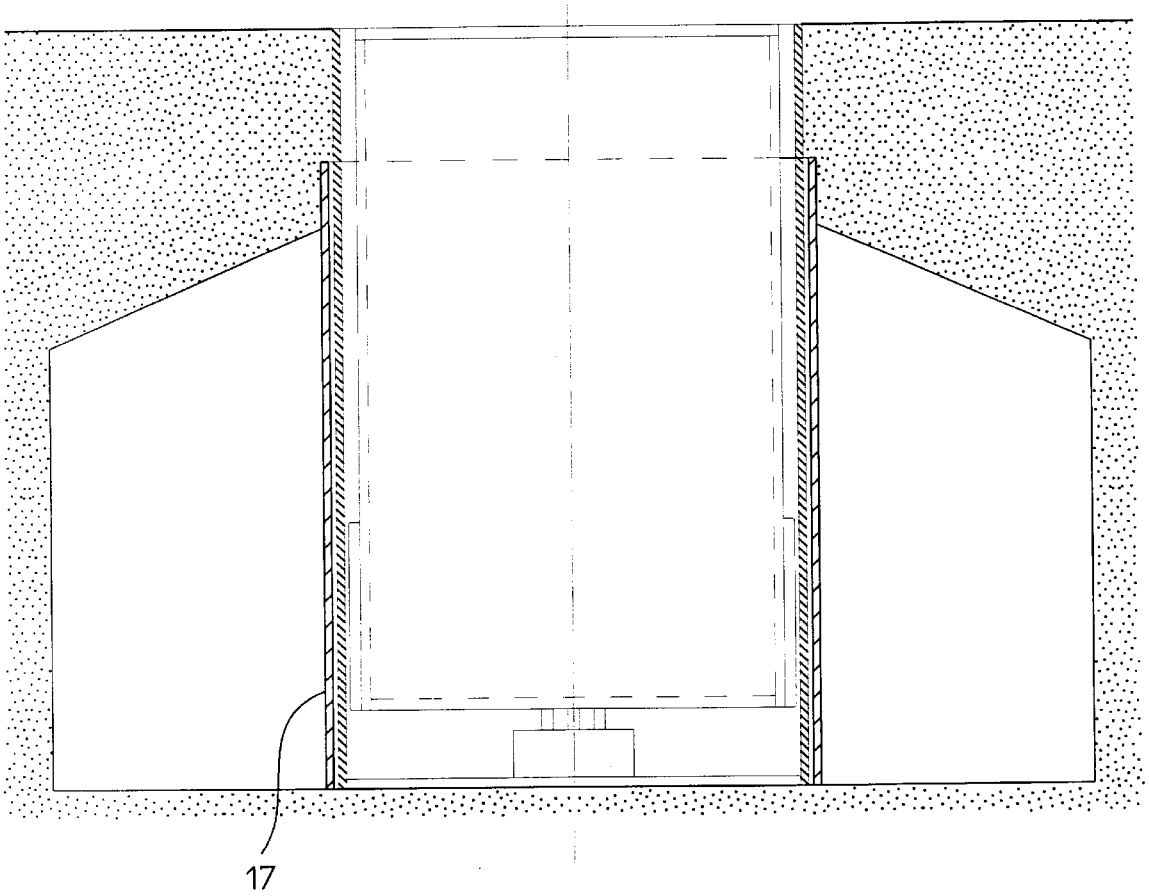

FIG. 3*b* is a side view of the subterranean anchor.

Figure 4A:
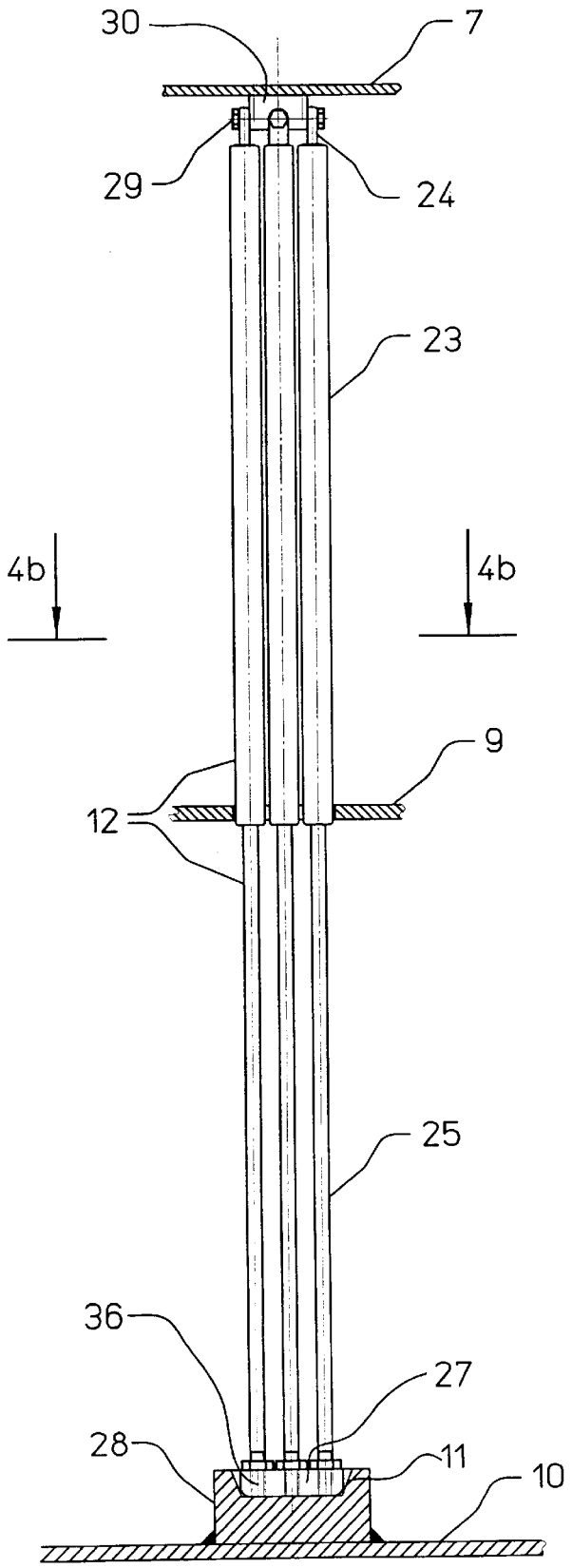

FIG. 4*a* is an enlarged side view of the lift mechanism in an extended position.

Figure 4B:
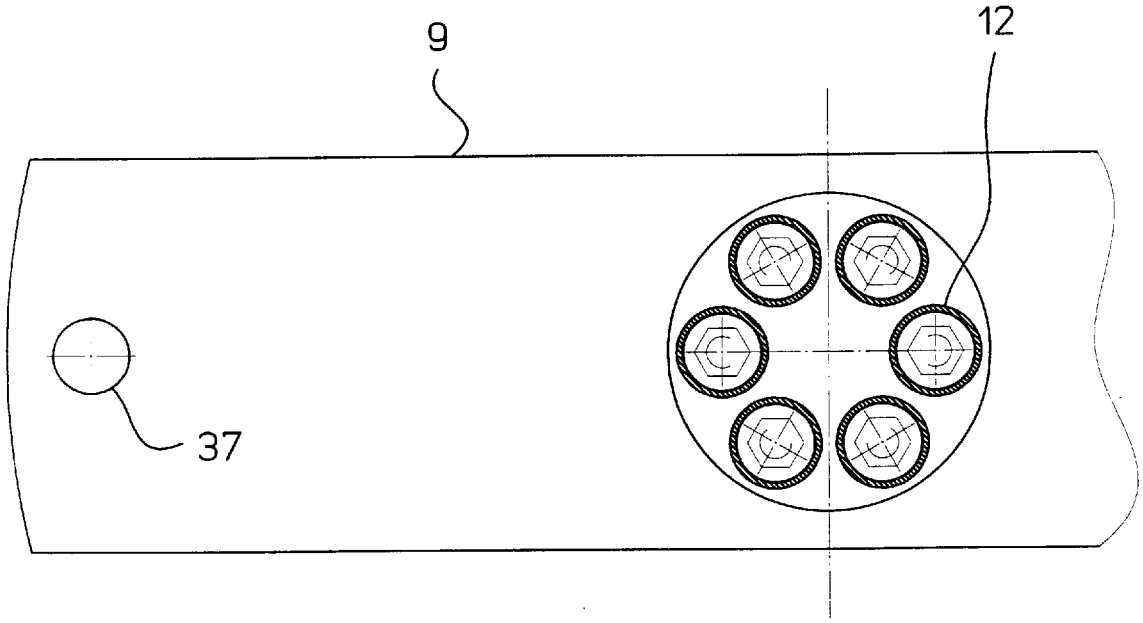

FIG. 4*b* is a top view of the middle guide member.

Figure 5:
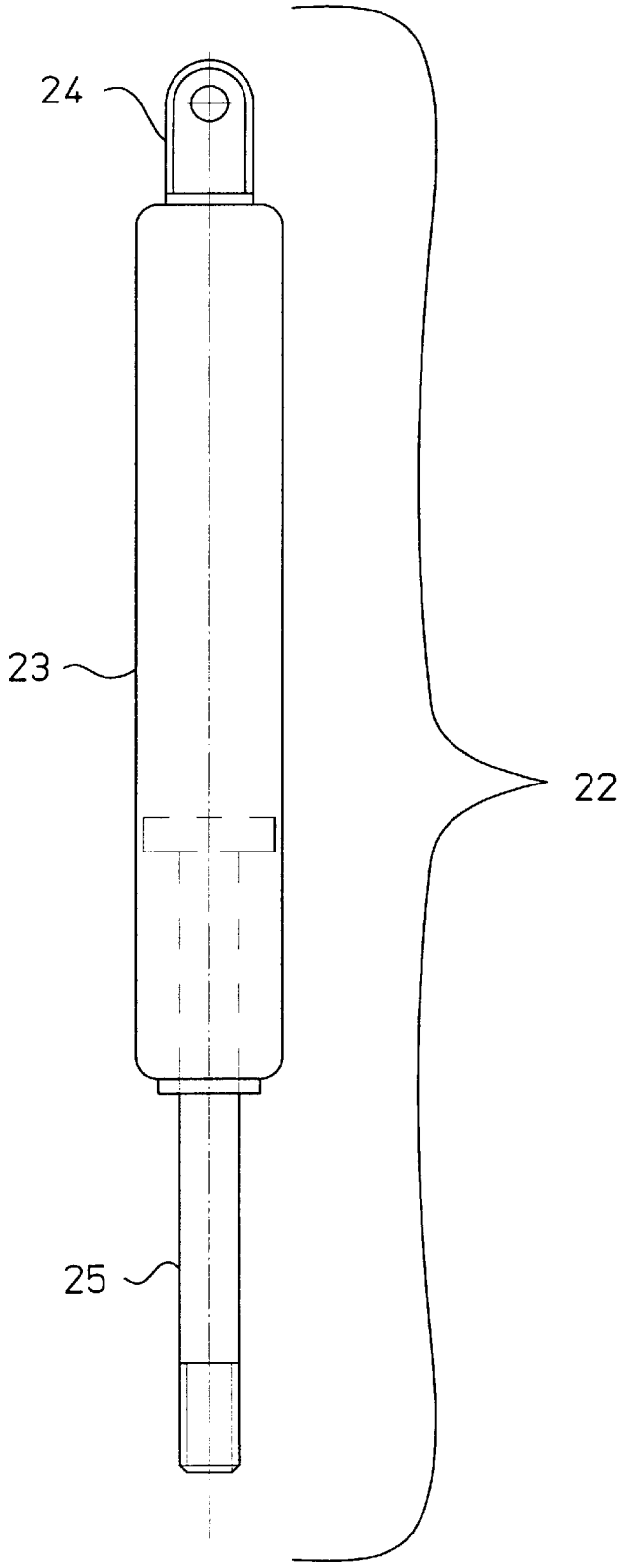

FIG. 5 is a side view of a single spring of the lift mechanism of the device of FIG. 1.

DETAILED DESCRIPTION OF THE INVENTION

As will be understood in the following discussion, the present invention is generally directed to a manually operated, multi-gas spring lift assisted bollard that is unique in its design. The present invention incorporates the simplistic designs found in manually activated systems yet is capable of lifting an exceptionally sturdy, heavier barrier and one that ensures operation through employment of a multi-gas spring element.

The Bollard of the present invention is so designed that the stored energy of the multi-gas spring lift mechanism and the weight of the telescoping bollard member are at or near equilibrium at a specific temperature range of C-20-+40, whereby the telescoping bollard member will rise solely through the stored energy of the multi-gas spring pod and is retracted into the foundation casing with minimal human power (20 Kp). The telescoping bollard member will automatically extend telescopically when the stored energy of the multi-gas spring lift mechanism is released. This extension occurs when the locking mechanism is released.

A feature of this device is that when retracted it is flush with the grade. The bottom of the foundation casing is open excluding a single connecting brace transversing the diameter of the foundation casing. The telescoping bollard is also open at the lower end. This open-end construction allows for fine particles of dirt and debris to fall or be rinsed away and allows for easy subterranean drainage. The device is set upon a bed of gravel that ensures proper drainage and the device is also embedded in conical concrete foundation. The connecting brace transversing the bottom of the foundation casing is employed to connect the lower pan element in which an upper pan element rests. Connected to the upper pan element are the multi-gas spring piston rods. This upper pan, lower pan assembly allows for secure fastening of the multi-gas spring lift mechanism to the foundation casing and allows for easy exchange of the individual gas springs or multi-gas spring lift mechanism.

An embodiment of the locking mechanism in both the extended and retracted position includes a rotating spindle located inside the telescoping bollard and extending vertically the length of the telescoping bollard. In the cover plate is a circular opening through which the upper end of the recessed rotating spindle is accessed directly. Affixed to the lower end of the spindle at a right angle is a metal flange. The flange extends horizontally and when rotated to a locked position rests in an opening found on the inner wall of the tubular foundation casing or above or below a receiving bolt affixed to the foundation casing. The opening or receiving bolts is in symmetry with the metal flange and blocks upward or downward movement of the telescoping bollard. The two openings or receiving bolts are aligned vertically along the wall of the foundation casing and are located in an upper and lower position corresponding to the extended and retracted position of the telescoping bollard. A key controls movement of the recessed spindle and is fitted directly to the upper end of the spindle. The key can be of various shape and design and adapted to the standards of various nations. The circular opening in t he cover plate can be secured by a variety of locks dependent upon the level of security desired or national standards.

The anti-terror security barrier as illustrated in FIGS. 1*a* and 1*b* is comprised of a tubular foundation casing 1 permanently installed below the grade and a telescoping bollard 2 which retracts and is telescopically extended out of the foundation casing 1. The telescoping bollard 2 has a retracted, non-obstructing position, FIG. 1*b*, and an extended obstructing position, FIG. 1*a*. The foundation casing has a central axis extending longitudinally along line AA that is co-aligned with the central axis of the telescoping bollard 2. The foundation casing 1 is constructed of tubular steel and has a diameter of at least 31 cm. The telescoping bollard 2 is also made of tubular steel and has a diameter of at least 30 cm and a wall gauge of 7 mm. Whereas the diameter is to ensure sufficient weight and stability. The foundation casing 1 is anchored in a conical concrete foundation and is seated upon a bed of gravel, which ensures effective subterranean drainage of surface water and fine debris. The foundation casing 1 and the telescoping bollard 2 are open at the bottom to allow for drainage and debris to fall through. The device is configured such that affixed between the foundation casing 1 and the telescoping bollard 2 is a self-contained multi-gas spring lift mechanism 12 to provide lift. The telescoping bollard 2 is extended from the retracted position to the extended obstructing position via a multi-gas spring lift mechanism 12.

As illustrated in FIGS. 1*a*, 1*b*, and 2, a feature of the present invention is the reinforcement and strengthening of the telescoping bollard member 2 intended to absorb and distribute energy from vehicular impact and arrest their movement. Said reinforcement consists of two or more steel flat plates 8 internally affixed between and to the front and rear inner walls of the telescoping bollard member 2 and running its full vertical length. The steel reinforcing plates 8 are welded in place. The reinforcing plates are at locations equidistant between the diameter of the telescoping bollard 2 and the opposite interior walls. The front of the telescoping bollard 2 is aligned toward the direction of vehicle impact with the steel plates 8 being parallel to the direction of vehicular impact. The telescoping bollard member 2 can also be reinforced with steel plates 8 welded to its interior walls of the in the form of a triangle or quadrate. This variation offers an omni-directional telescoping bollard 2 that does not require orientation toward the direction of vehicle impact.

The diameter of both the foundation casing 1 and the telescoping bollard member 2 are so constructed that a distance of not more 1 cm exists between the interior wall of the foundation casing 1 and the exterior wall of the telescoping bollard 2. This space allows for proper drainage and for fine particles of dirt and debris to fall freely onto the gravel foundation.

As illustrated in FIGS. 1*a*, 1*b*, and 2 the telescoping bollard 2 is retracted into the foundation casing 1 with the assistance of guide bushings 15 mounted vertically on the lower exterior walls of the telescoping bollard 2. The guide bushings 15 are welded to outer walls of the telescoping bollard 2 at 10 cm intervals from each other around the circumference of the telescoping bollard and are constructed the approximate length of the section of the telescoping bollard 2 which remains within the foundation casing 1 when fully extended. The guide bushings 15 also serve as a member of a retaining element that prohibits the telescoping bollard 2 from extending out of the foundation casing 1. When the telescoping bollard 2 is fully extended the upper end of the guide bushings 15 rest against the underside of a retaining collar 18 employed to both retain the telescoping bollard 2 in the foundation casing 1 and to serve as a collar to prohibit large particles of debris from falling between the telescoping bollard member 2 and foundation casing 1. The retaining collar 18 is affixed to the foundation casing 1 with bolts 13.

The guide bushings 15 are so constructed that they will absorb the minor impact of a vehicle which may accidentally hit the telescoping bollard 2 in a parking or turning maneuver, as an example. With severe impact, however, the guide bushings 15 are designed to collapse in order to maximize the contact surface between the foundation casing 1 and the section of telescoping bollard 2 which remains within the foundation casing when the device is fully extended. As illustrated in FIGS. 1*a*, 1*b*, and 2 the foundation casing 1 has running through its vertical length two circumferentially located guide-rails 20. The two circumferentially located guide-rails 20 receive between them a metal guide strip 21 running vertical and affixed to the outer wall of the telescoping bollard 2. The guide-rails 20 and the metal guide strip prohibit rotation of the telescoping bollard 2 on its vertical axis.

As illustrated in FIGS. 1*a*, 1*b*, 2, and 4*a* located internally between the telescoping bollard 2 and the foundation casing 1 centered along the vertical axis is a multi-gas spring lift mechanism 12. The telescoping bollard 2 is lifted from the retracted position to the extended position via the gas spring lift mechanism 12. The series of gas springs or multi-gas springs are mounted in circular fashion similar to the chamber of a revolver pistol.

As best illustrated in FIGS. 4*a* and 5 the gas spring is comprised of a compression cylinder 23, which has a flanged eyelet 24 welded to its upper end, and a piston rod 25, which extends from its lower end. The piston rod 25 lower end is externally threaded and screw ed into the internal threads of a receiving pan 11 that is bored with multiple sockets 36. As best illustrated in FIG. 4*a* the receiving pan member 11 consists of two components, solid upper component 27 and a lower concave component 28. The upper component 27 sits firmly in the lower component 28 prohibiting lateral movement of the multi-gas spring lift mechanism 12. The receiving pan member 11 is centered upon a quadrilateral connecting brace 10 traversing the diameter of the bottom of the foundation casing 1 and is welded in place. The connecting brace 10 is welded to the lower side of the foundation casing 1. The compression cylinders 23 of the gas springs 22 are affixed to the upper end of the upper quadrilateral connecting braces 7 with cotter pins 29 or similar device through the flanged eyelet 24 to clevises 30 located on the upper quadrilateral connecting braces 7. The gas springs 22 are individually affixed to connecting braces 7. As best illustrated in FIG. 4*b* welded to the lower end of telescoping bollard 2 is a mid-level guide 9 in the form of a circle.

When replacement of the gas-spring lift mechanism 12 is required, the entire telescoping bollard 2 with the connected multi-gas spring lift mechanism 12 can be easily removed as the multi-gas spring lift mechanism 12, that is connected to the upper pan 27 element is not permanently affixed to the lower pan element 28.

As illustrated in FIGS. 1*a*, 1*b*, and 2 a steel cover plate 3 is affixed to the telescoping bollard 2 with sunken bolts 13 or is welded in place. Welded to the upper end of the telescoping bollard 2 and flush with the upper end are four or more angle irons 31, which receive the bolts 13. The sunken bolts 13 are sealed with zinc to conceal their position and are located for repair with aid of a template. In the center of the cover plate 3 is an inset eyelet 19. The eyelet is used in conjunction with a portable handle to manually raise the telescoping bollard 2 by hand in the unlikely event of a malfunction. Additionally, a screw employed in the eyelet provides a connecting point for the lifting of the device by a crane.

As illustrated in FIGS. 1*a*, 1*b*, and 2 located in the cover plate is a circular opening 14 through which the upper end of the recessed rotating spindle 4 is accessed directly. The rotating spindle 4 is held in place by a spindle brace 6 or similar device that is welded to the interior wall of the telescoping bollard 2. The spindle 4 passes through a bore 38 in the horizontal oriented flange of the spindle brace 6. The lower end of the activation spindle 4 passes through a second guide bore 37 located in the middle guide 9. Affixed to the lower end of the activation spindle 4 at a right angle is a metal flange 33. Located on or in the inner walls of the foundation casing 1 are a number of receiving means which function with the metal flange 33. As shown in FIGS. 1*a* and 1*b*, the receiving means may comprise stop bolts or openings located vertically along the inner wall of the foundation casing 1 at positions in symmetry with the location of the rotating flange 33 at the fully extended and retracted positions of the telescoping bollard 2. The flange extends horizontally and when rotated to a locked position rests in a opening 5 in the inner wall of the foundation casing 1 or above or below stop bolts dependent upon if in the extended or retracted position. The opening or stop bolts 5 are aligned with the metal flange 33 and blocks upward or downward movement of the telescoping bollard 2. There are two vertically aligned openings/stop bolts in the foundation casing 1 and located in an upper and lower position corresponding to the extended and retracted position of the telescoping bollard 2. A unique key controls movement of the spindle 4 and is fitted directly to the upper activation end of the spindle 4. The key can be of various shape and design and adapted to the standards of various nations.

As illustrated in FIGS. 3*a* and 3*b* the bollard device can be adapted for quick and temporary periods of employment with the use of a subterranean anchor 17. The subterranean anchor is comprised of a steel tube foundation with three bolted or welded wings. Additionally, as illustrated in FIG. 1*c* the device can be adopted to operate with an electronic activation device such as a solenoid 16.

It will be understood by those skilled in the art that various modifications and changes can be made to the various embodiments disclosed herein without departing from the spirit and scope of the invention. For example, the locking mechanism can be made to be automatic, various lift assist mechanisms may be used within the weight equilibrium parameters, various configurations for reinforcement of the telescoping bollard can be employed, etc, therefore the above description should not be construed as limiting, but merely as exemplary embodiments. Those skilled in the art will envision other modifications within the spirit and scope of the invention as defined by the claims set forth hereinbelow.

We claim:

1. A security barrier to protect/block entranceways and provide a security perimeter against attacks comprising:

a foundation casing member, the casing member adapted to be installed below grade;

a bollard member telescopically positioned in relation to the casing member, the bollard member being retractable and extendible with respect to the casing member, the bollard member being reinforced to resist collapse and increase the absorption of kinetic energy; and a lift element comprising at least two gas charged spring members affixed between the casing member and the bollard member, the gas charged spring member being able provide lift assistance between the casing member and the bollard member.

2. The device of claim 1, wherein the telescoping bollard is cylindrical in form and when in the extended position a minimum of 25% of its full length remains within the casing member.

3. The device of claim 1 wherein the telescoping bollard member is internally reinforced with steel plates in order to resist collapse and increase the absorption of kinetic energy.

4. The device of claim 1 wherein the lift element consists of said several gas charged springs employed in unison.

5. The device of claim 1 wherein guide bushings are mounted on the exterior of the telescoping bollard member.

6. The device of claim 5 wherein the guide bushings are collapsible upon high impact of the telescoping bollard member.

7. The device of claim 1 additionally comprising a locking mechanism being acutable to restrict movement of the bollard member with respect to the casing member when the bollard member is fully retracted and when the bollard is fully extended.

8. The device of claim 7 wherein the locking mechanism can only be activated with a specially designed key of unique form.

9. The device of claim 8 wherein the activation mechanism is subsurface affixed to the inner side of the telescoping bollard member and can be electromechanical with remote activation.

10. The device of claim 1 wherein the foundation casing member is anchored through use of a winged casing flange.

11. The device of claim 1 wherein the telescoping bollard member comprises a head plate which contains an eyelet for use of a handgrip for manual activation of the device.

12. The device of claim 4 wherein the stored energy of the multi-gas springs and the weight of the telescoping bollard member are at equilibrium such that at temperatures of more than −30° C., the bollard member is extendible solely through the stored energy of the multi-gas spring member.

13. The device of claim 1 which additionally comprises a cover plate having a circular or semi-circular opening which can be independently secured by locking means.

14. The device of claim 1 which additionally comprises a collar member positioned at the end of the foundation casing member to preclude dirt and debris from falling between the casing member and the bollard member and to prevent extension of the telescoping member out of the casing member.

15. The device of claim 1 wherein guide rails and bushings are mounted on the outer walls of the telescoping bollard.

16. The device of claim 1 which additionally comprises a locking mechanism having arotating spindle which engages a horizontal flange into receiving openings or above or below stop bolts to prevent telescopic movement of the bollard with respect to the casing member.

* * * * *